US007727028B1

(12) United States Patent
Zhang et al.

(10) Patent No.: US 7,727,028 B1
(45) Date of Patent: Jun. 1, 2010

(54) ELECTRICAL CONNECTOR WITH CONTACT TERMINALS DESIGNED TO IMPROVE IMPEDANCE

(75) Inventors: George (Huanyl) Zhang, Irvine, CA (US); Gustavo F. Duenas, Placentia, CA (US); Bin Pan, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/460,190

(22) Filed: Jul. 14, 2009

(51) Int. Cl.
*H01R 24/00* (2006.01)

(52) U.S. Cl. ..... 439/660; 439/108

(58) Field of Classification Search ..... 439/79, 439/83, 660, 941, 108
See application file for complete search history.

(56) References Cited

U.S. PATENT DOCUMENTS 5,626,497 A * 5/1997 Bouchan et al. ..... 439/676
5,697,817 A * 12/1997 Bouchan et al. ..... 439/676
6,120,329 A * 9/2000 Steinman ..... 439/676
7,004,792 B2 * 2/2006 Shimizu ..... 439/607.36
7,090,540 B2 * 8/2006 Masumoto et al. ..... 439/660
2003/0162446 A1 * 8/2003 Ho et al. ..... 439/660
2005/0118879 A1 * 6/2005 Shimizu ..... 439/660

* cited by examiner

*Primary Examiner*—Tho D Ta
(74) *Attorney, Agent, or Firm*—Wei Te Chung; Andrew C. Cheng; Ming Chieh Chang

(57) ABSTRACT

An electrical connector includes a row of terminals (20) having a pair of differential signal terminals (21) mounted on a mating tongue (11). Each of the signal contact terminals has a rear end (211) on a back outer face of the connector and a free mounting end (213) away from the back outer face. The free mounting ends are located on a first end row and bent from the rear ends and away from each other in opposite transverse directions so as to widen a pitch therebetween to improve impendence for decreasing interference.

16 Claims, 9 Drawing Sheets

ELECTRICAL CONNECTOR WITH CONTACT TERMINALS DESIGNED TO IMPROVE IMPEDANCE

BACKGROUNDING/POWER OF THE INVENTION

1. Field of the Invention

The present invention generally relates to an electrical connector, and more particularly to an electrical connector with contact terminals having at least one differential pair of signal contact terminals spaced with a predetermined distance to improve impendence.

2. Description of Related Art

U.S. Pat. No. 6,752,656 discloses an electrical connector having an insulative housing defining a mating tongue, and a plurality of contact terminals mounted on a first surface of the mating tongue. The contact terminals include pairs of differential signal contacts having free mounting ends extending out of the insulative housing for being mounted onto a printed circuit board, and contact sections mounted on the first surface of the mating tongue. The lateral spacing distance or pitch between the contact sections of every two adjacent contact terminals is equal as required by the Serial ATA specification, and even equal to a lateral spacing distance or pitch defined between the free mounting ends of every two adjacent contact terminals. This configuration of contact terminals has impendence not in line with the customer's requirement.

BRIEF SUMMARY OF THE INVENTION

An object of the invention is to provide an electrical connector including contact terminals having free mounting ends with predetermined spacing distances to improve impendence, thereby decreasing interference therebetween.

An electrical connector according to an embodiment of the present invention includes an insulative housing having a mating tongue exposed in a mating port, with the mating tongue having a first surface exposed thereon, and a row of contact terminals mounted on the mating tongue. The row of contact terminals at least includes a pair of differential signal contact terminals adjacently disposed with each other and a pair of grounding/power contact terminals, the pair of differential signal contact terminals located between said grounding/power contact terminals. The grounding/power contact terminals and the signal contact terminals have respective grounding/power contact sections and signal contact sections mounted on the first surface of the mating tongues and equidistantly spaced along a row direction of said contact terminals. Each of the differential signal contact terminals has a rear end on a back outer face of the insulative housing and a free distal mounting end located away from the back outer face. The free mounting ends are located on a first end row and bent from the rear ends and away from each other in opposite transverse directions such that a transverse spacing distance or pitch between the adjacent free mounting ends is larger than a transverse spacing distance between the adjacent rear ends. Thus, the larger spacing distance or pitch between the adjacent free mounting ends of the differential signal contacts is capable of improving impendence, thereby having better interference capability for decreasing interference therebetween.

Other objects, advantages and novel features of the invention will become more apparent from the following detailed description of the present embodiment when taken in conjunction with the accompanying drawings.

DETAILED DESCRIPTION OF THE INVENTION

Figure 1:
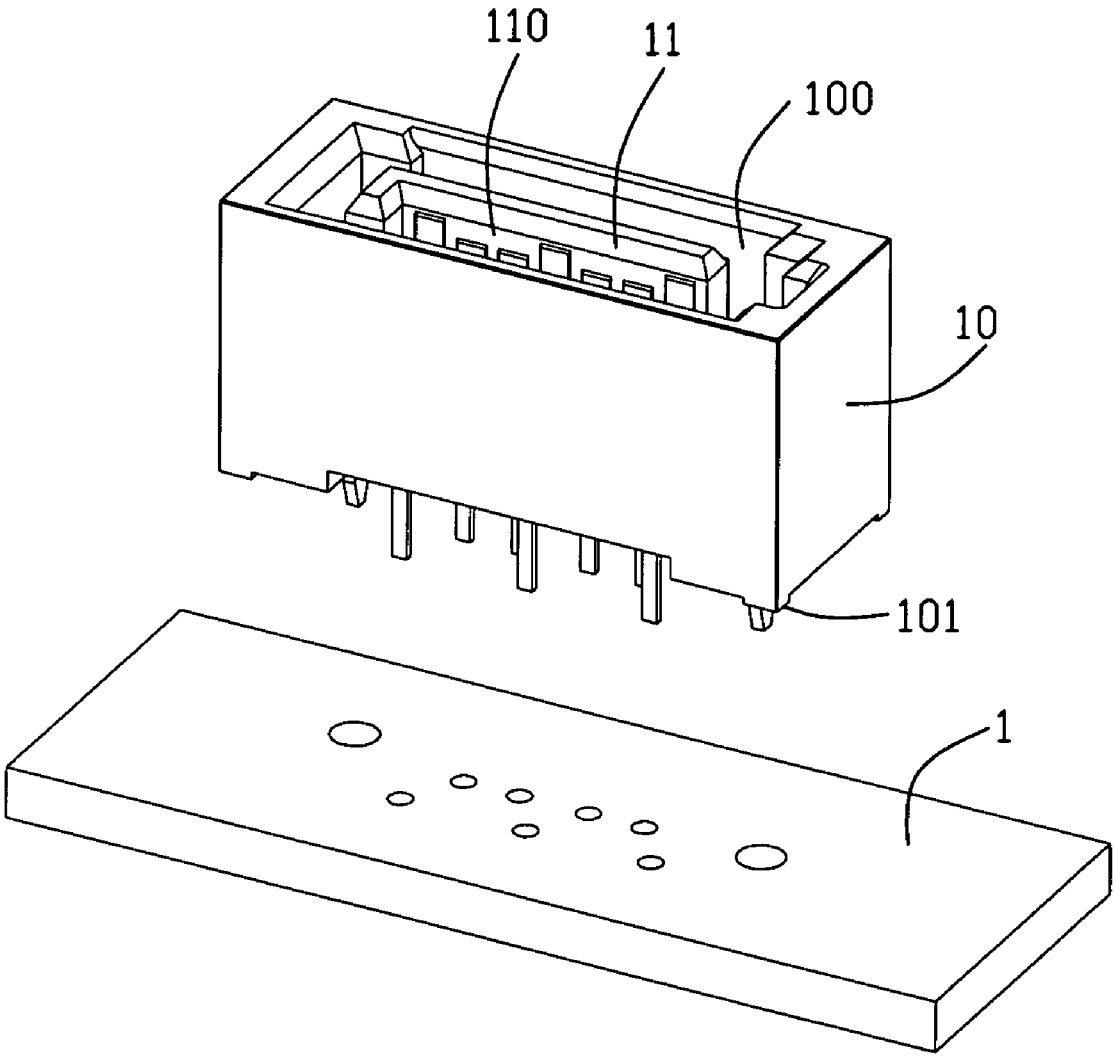
FIG. 1 is an assembled, perspective view of an electrical connector to be mounted onto a printed circuit board in accordance with a first embodiment of the present invention.

Reference will now be made to the drawing figures to describe the present invention in detail.

Figure 2:
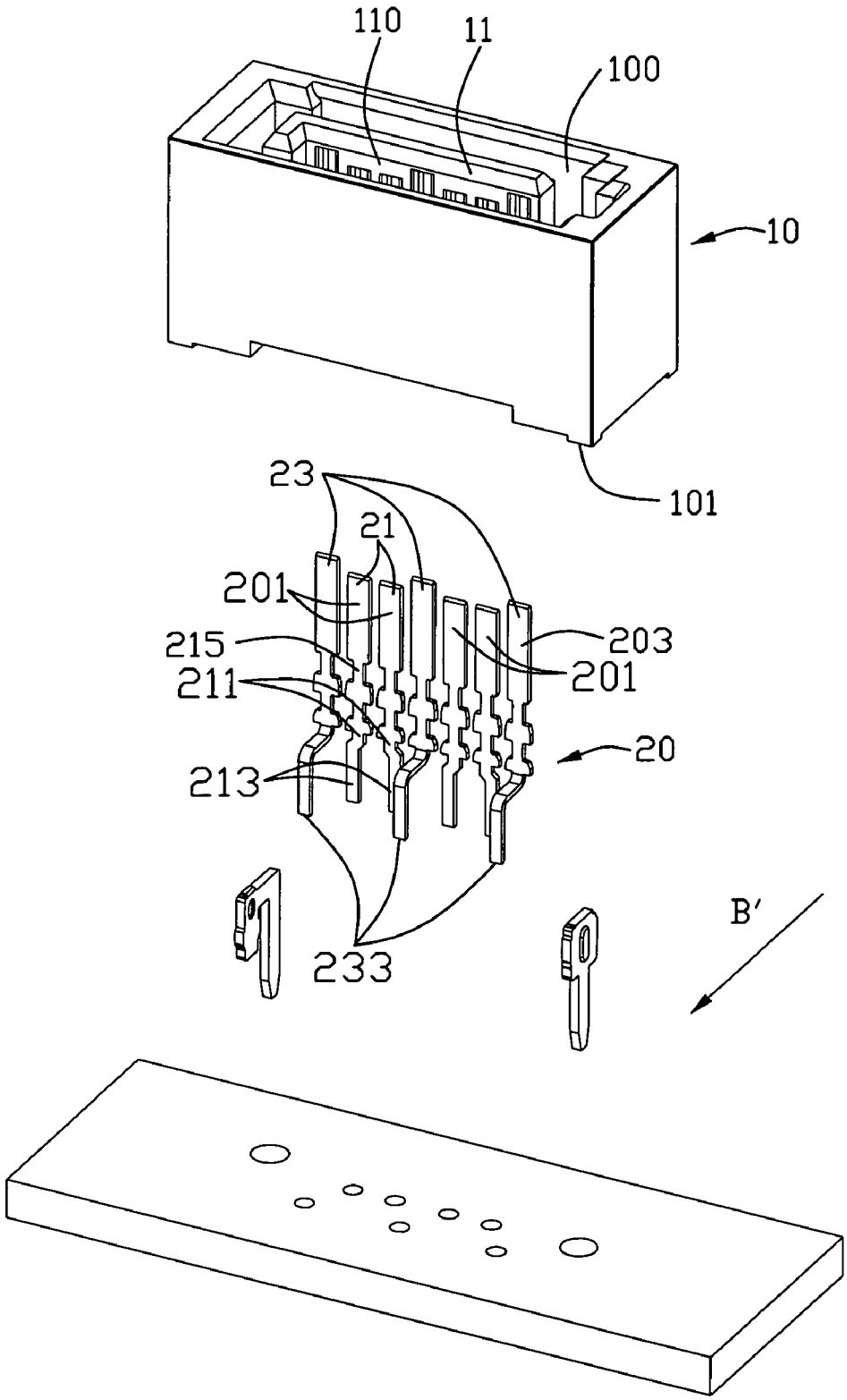
FIG. 2 is an exploded, perspective view of the electrical connector of FIG. 1.
Figure 3:
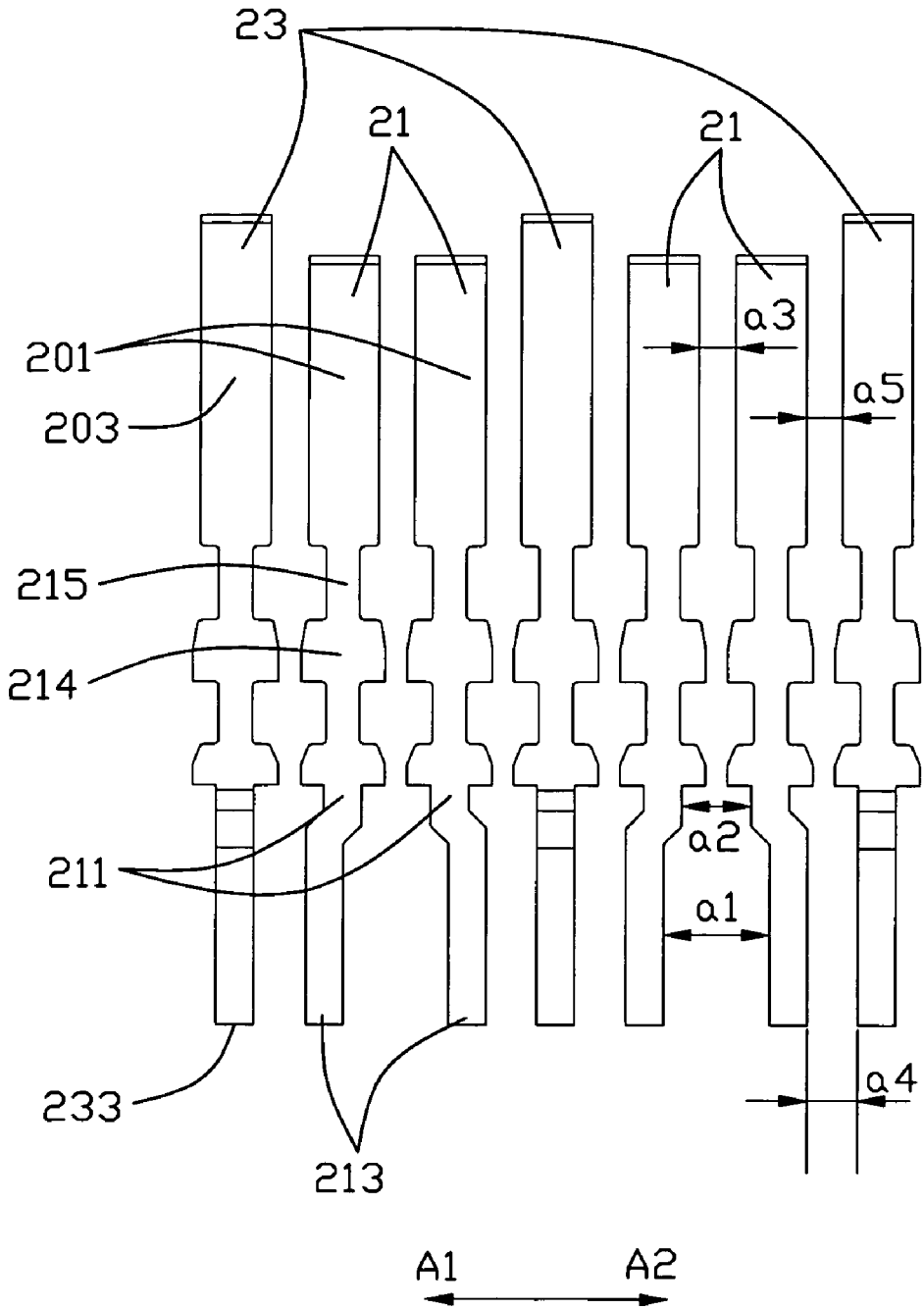
FIG. 3 is a front view of the contact terminals of FIG. 2.
Figure 4:
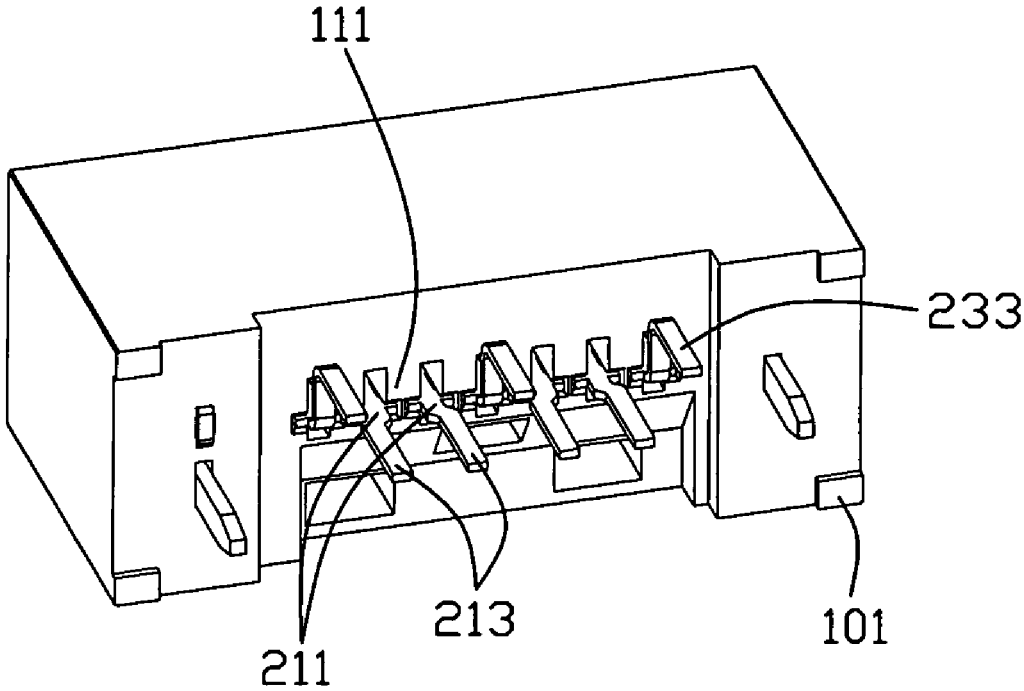
FIG. 4 is another assembled, perspective view showing free ends of the contact terminals of FIG. 1 located in two different end rows.
Figure 5:
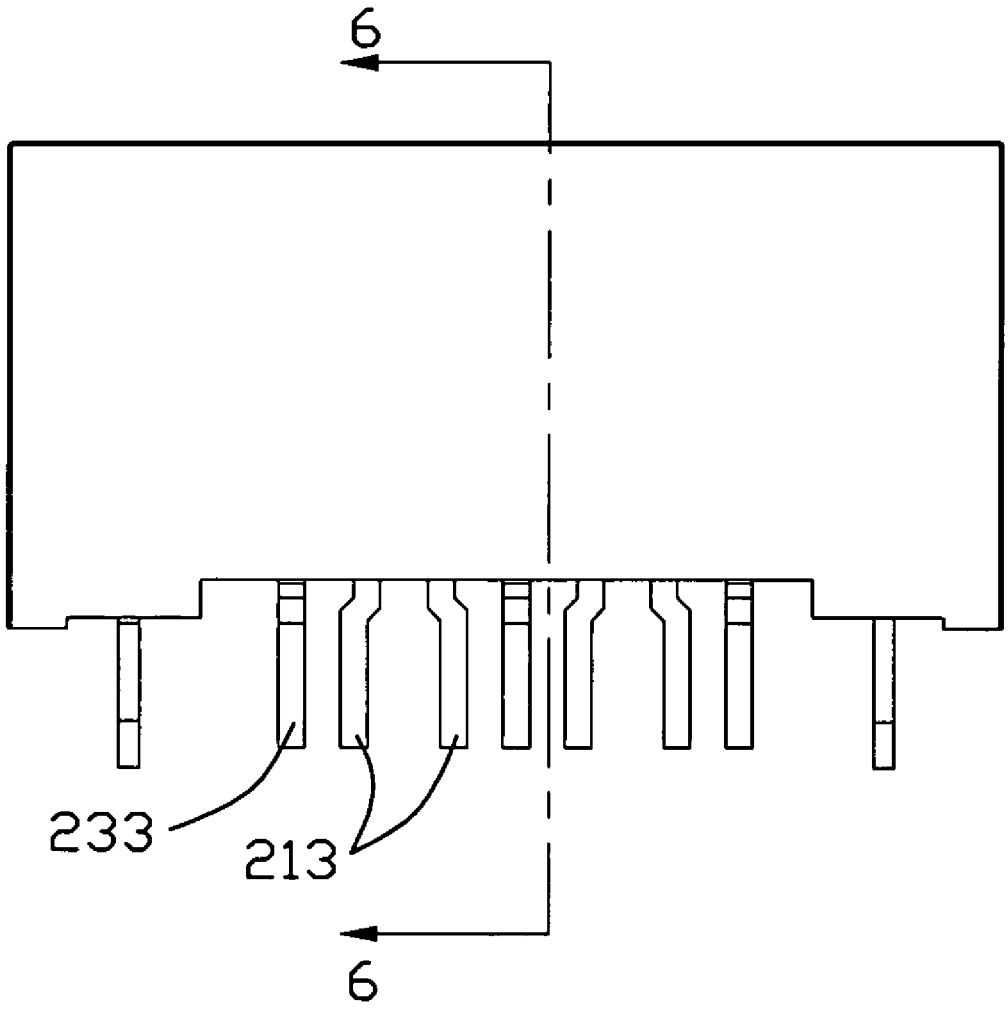
FIG. 5 is a front view of the electrical connector of FIG. 1.
Figure 6:
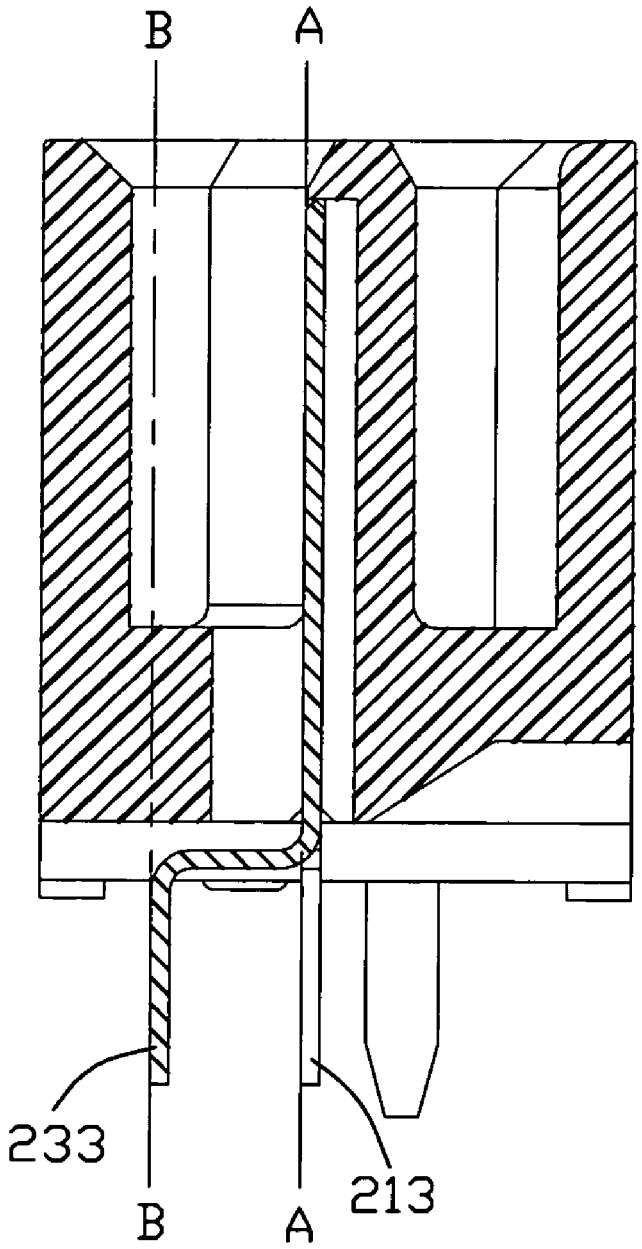
FIG. 6 is a cross sectional view of the electrical connector of FIG. 5, taken along line 6-6 thereof.

Referring to FIGS. 1-3 in conjunction with FIGS. 4-6, an electrical connector to be mounted onto a printed circuit board 1 in accordance with a first embodiment of the present invention includes an insulative housing 10 defining a mating port 100 for mating with a complementary connector to be inserted thereinto, and a mounting face 101 for mounting to the printed circuit board 1. In this embodiment, a mating tongue 11 is configured to extend forwardly from an interior back wall of the insulative housing 10 and exposed in the mating port 100. A row of contact terminals 20 is mounted or disposed on an exposed first surface 110 of the mating tongue 11. In this embodiment, the row of contact terminals 20 includes two differential pairs of signal contact terminals or two pairs of differential signal contact terminals 21 and three grounding contact terminals 23. The differential signal contact terminals 21 within each pair are adjacently disposed with each other and located between every two grounding contact terminals 23. In other words, two grounding contact terminals 23 are respectively located at the outmost sides of the row of contact terminals 20 with one grounding contact terminal 23 located between the two pairs of differential signal contact terminals 21. As shown in FIG. 2, the grounding contact terminals 23 and the signal contact terminals 21 have respective grounding mating contact sections 203 and signal mating contact sections 201 mounted on the first surface 110 of the mating tongue 11, i.e., exposed in the mating port 100, and have respective free tailing ends or grounding mounting sections 233, and free distal ends or signal mounting sections 213, all exposed on the mounting face 101. The grounding contact sections 203 and signal contact sections 201 are stiff and planar, and equidistantly spaced along a row direction of the contact terminals 20. In other words, a pitch a3 between the mating sections 201 of the same differential pair of signal contacts 21 is same with a pitch a5 between the mating portion 203 of one of the grounding contacts 23 and the mating section 201 of the adjacent one of the differential pair of signal contacts 21, which is required by the Serial ATA specification and has no change to this configuration.

Each of the differential signal contact terminals 21 has a rear end 211 on a back outer face 111 of the insulative housing 10 and a free distal end 213 located away from the back outer face 111 for being mounted onto the printed circuit board 1. The free distal ends 213 of the differential signal contact terminals 21 are located on a first end row and bent from the rear ends 211 and away from each other in two opposite transverse directions as dictated by "A1" and "A2". Each of the grounding contact terminals 23 has a free tailing end 233 located on a second end row different from the first end row and bent from the grounding contact terminal 23 in a first lengthwise direction as dictated by "B" perpendicular to one of the transverse directions "A1" and "A2" relative to one adjacent signal contact terminal 21, and thereby spaced with a distance from one adjacent free distal end 213 of the signal contact terminal 21 in the first lengthwise direction "B" perpendicular to one of the transverse directions "A1" and "A2". That is, the mating sections 201 of the differential pairs of signal contacts 21 and the mating portions 203 of the grounding contacts 23 are located in a first plane A-A while the mounting sections 213 of the differential pair of signal contacts 21 are also located in the first plane A-A while the mounting portions 233 of the grounding contacts 23 are located in a plane B-B different from the first plane A-A. In this embodiment, a transverse pitch in the transverse direction "A1" between the mounting sections 213 of the same differential pairs of signal contacts may be essentially equal to a lengthwise pitch in the first lengthwise direction "B" between the mounting portion 233 of one of the grounding/powering/power contacts and the mounting section 213 of the adjacent one of the differential pair of signal contacts.

In addition, as shown in FIG. 3, each of free distal ends 213 or tailing ends 233 in width is less than that of a corresponding contact section 201 of the signal contact terminals 21 or mating section 203 of the grounding contact terminals 23 by specially cutting a portion of the distal end 213 or tailing end 233 in order to widen a corresponding pitch between every two adjacent free ends of the grounding contact terminals 23 and signal contact terminals 21 to improve impendence therebetween. In other embodiments, if each of free distal ends 213 or tailing ends 233 in width was the same to that of a corresponding contact section 201 of the signal contact terminals 21 or mating section 203 of the grounding contact terminals 23 with no cutting process, a pitch between the mating portions 203 of the grounding contacts 23 is essentially same with that between the mounting portions 233 of the grounding contacts 23. Further, at least a portion of the signal contact terminal 21 or the grounding contacts 23 disposed on the first surface 110 of the mating tongue 11, is necked so as to widen a corresponding pitch between every adjacent two contact terminals 20 of the row. More specifically, each of the differential signal contact terminals includes a retention section 214 retained on the mating tongue and a connecting section 215 located between the signal contact section 201 and the retention section 214, and the connecting section 215 in width is less than any one of the retention section 214 and the signal contact section 201 to widen the above-described pitch so as to improve impendence therebetween.

The pitch a5 between the mating portion 203 of one of the grounding contacts 23 and the mating section 201 of the adjacent one of the different pair of signal contacts 21 is smaller than a pitch a4 between the mounting portion 233 of said one of the grounding contacts 23 and the mounting section 213 of said adjacent one of the differential pair of signal contacts 21. A transverse spacing distance or pitch a1 between the adjacent free distal ends 213 of the differential pair of signal contact terminals 21 is larger than a transverse spacing distance or pitch a2 between the adjacent rear ends 211 of the signal contact terminals 21, and is also larger than a transverse spacing distance or pitch a4 between the mounting portion 233 of said one of the grounding contacts and the mounting section 213 of said adjacent one of the differential pair of signal contacts 21. A pitch a3 between the contact sections or mating sections 201 of the differential pair of signal contacts 21 is smaller than the pitch a1 between the free distal ends or mounting sections 213 of the same differential pair of the signal contacts 21. Therefore, the widen pitch a1 of the differential pair of the signal contacts 21 is configured to improve impendence, having better interference capability to decrease interference therebetween.

Figure 7:
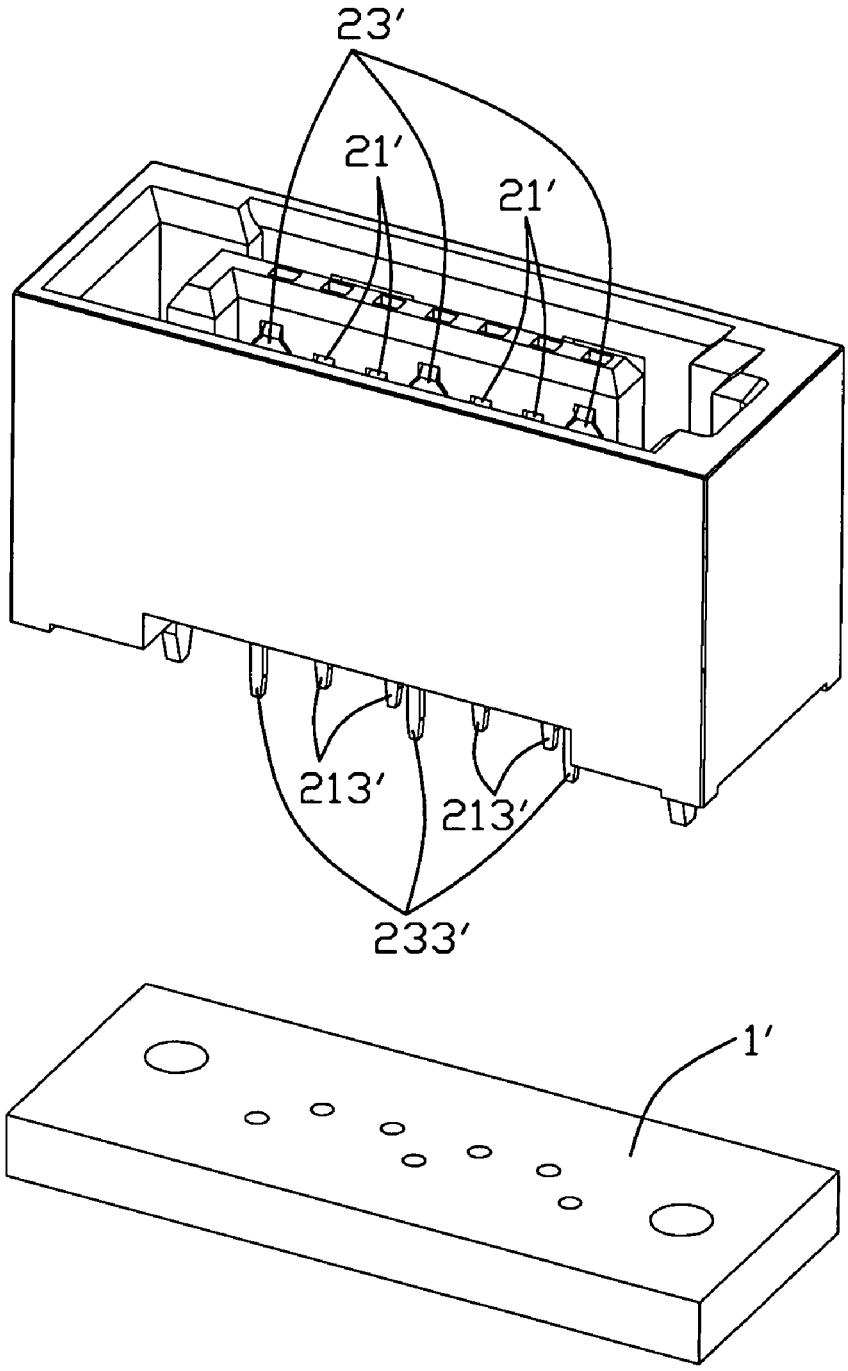
FIG. 7 is an assembled, perspective view of an electrical connector to be mounted onto a printed circuit board in accordance with a second embodiment of the present invention.
Figure 8:
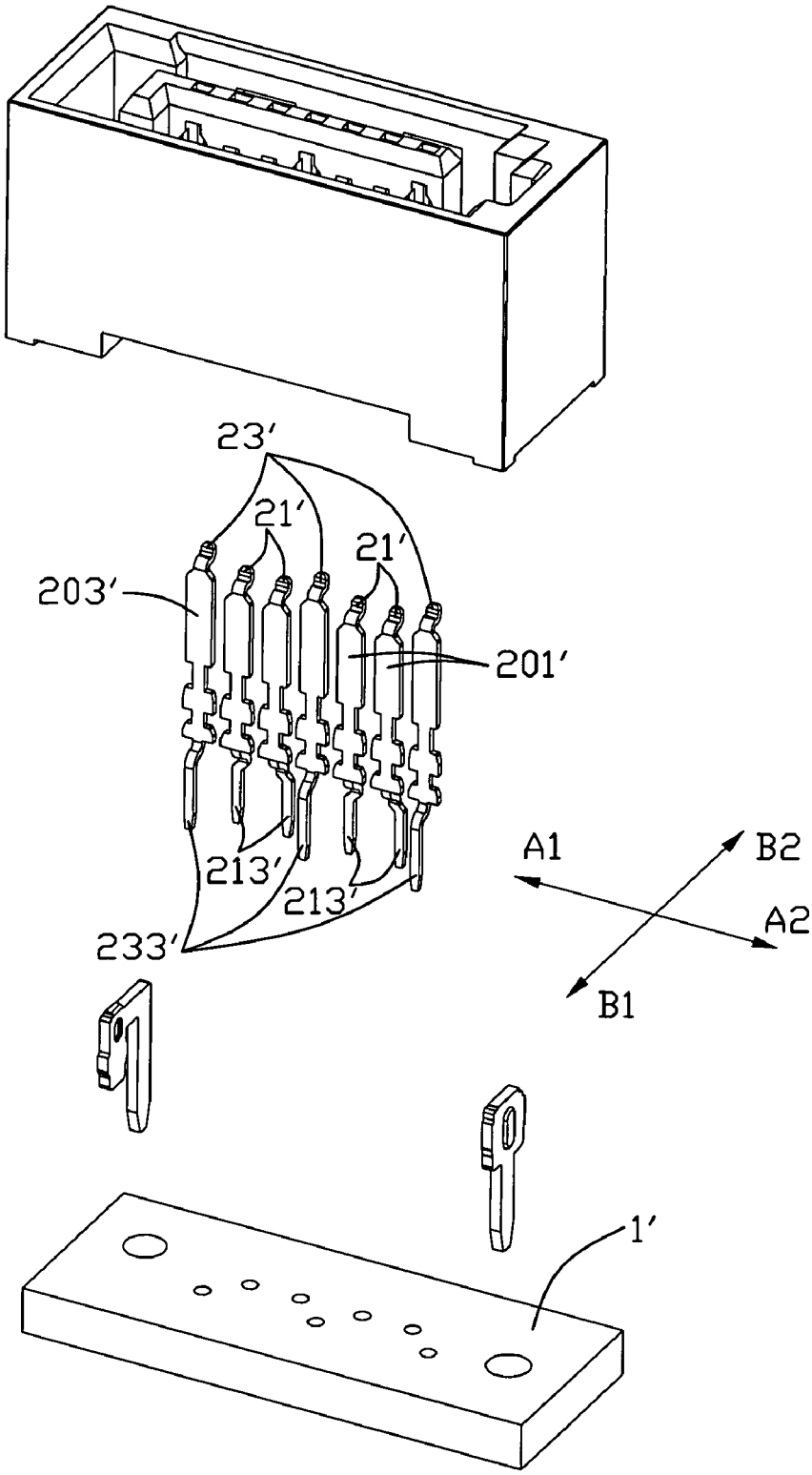
FIG. 8 is an exploded, perspective view of the electrical connector of FIG. 7.
Figure 9:
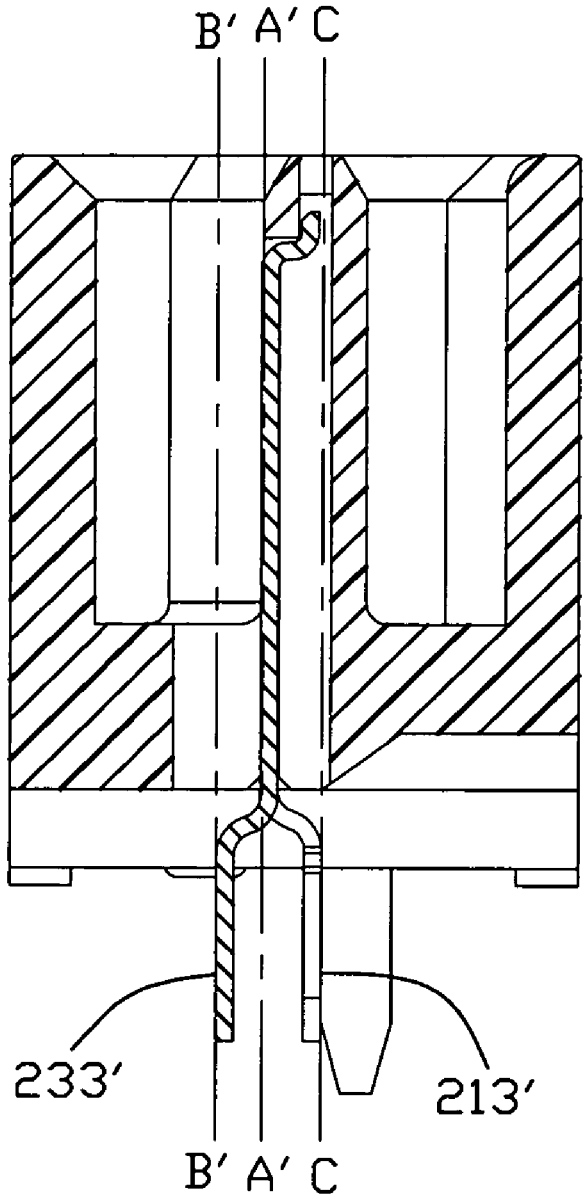
FIG. 9 is a cross sectional view of the electrical connector of FIG. 7.

Referring to FIGS. 7-9, an electrical connector to be mounted onto a printed circuit board 1' in accordance with a second embodiment of the present invention is shown. The electrical connector of the second embodiment is the same to that of the first embodiment except that each of the free distal ends 213' of the signal contacts 21' are also bent in a second lengthwise direction B2' opposite to the first lengthwise direction B1'. That is, the mating sections 201' of the differential pairs of signal contacts 21' and the mating portions 203' of the grounding contacts 23' are located in a first plane A'-A' while the mounting sections 213' of the differential pair of signal contacts 21' are also located in the second plane C-C while the mounting portions 233' of the grounding contacts 23' are located in a third plane B'-B' different from the second plane C-C. In addition, the structure of the contact sections 201' and 203' of the contact terminals is somewhat different to that of the first embodiment.

While two differential pairs of signal contact terminals and three grounding contact terminals are preferred, a plurality of differential pairs of signal contacts and a plurality of grounding/power contacts can be also employed. Herein, the grounding/power contact refers to one can be selectively assigned with a grounding or power function as required.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector, comprising:

an insulative housing including a mating tongue exposed in a mating port, said mating tongue having a first surface exposed thereon;

a row of contact terminals mounted on the mating tongue and at least including a pair of differential signal contact terminals adjacently disposed with each other and a pair of grounding/power contact terminals, the pair of differential signal contact terminals located between said grounding/power contact terminals, said grounding/power contact terminals and said signal contact terminals having respective grounding/power contact sections and signal contact sections mounted on the first surface of the mating tongues and equidistantly spaced along a row direction of said contact terminals;

each of said differential signal contact terminals having a rear end on a back outer face of the insulative housing and a free distal end located away from said back outer face, said free distal ends located on a first end row and bent from said rear ends and away from each other in opposite transverse directions such that a transverse spacing distance between said adjacent free distal ends is larger than a transverse spacing distance between said adjacent rear ends.

2. The electrical connector as recited in claim 1, wherein each of said differential signal contact terminals includes a retention section retained on the mating tongue and a connecting section located between said signal contact section and the retention section, said connecting section in width being less than any one of said retention section and said signal contact section.

3. The electrical connector as recited in claim 1, wherein and each of said grounding/power contact terminals has a free tailing end located on a second end row different from the first end row.

4. The electrical connector as recited in claim 3, wherein each of said free tailing ends is bent from the grounding/power contact terminal with a distance spaced from one adjacent free distal end of the signal contact terminal in a first lengthwise direction perpendicular to one of said transverse directions.

5. The electrical connector as recited in claim 4, wherein each of said free distal ends of the signal contact terminals is spaced from one adjacent free tailing end of the grounding/power contact terminal in a second lengthwise direction opposite to the first lengthwise direction.

6. An electrical connector, comprising:

an insulative body having a mating tongue extending forwardly from a back wall of the insulative body;

a plurality of contacts disposed on a surface of the mating tongue and equidistantly spaced from each other;

said contacts at least including two type contacts, including:

two first type contacts; and two second type contacts adjacently disposed with each other and located between the two first type contacts, said first type contacts having free tailing ends located in a first row, said second type contacts having free distal ends located in a second row different from the first row; and wherein said free distal ends are bent from said second type contacts and away from each other in two opposite transverse directions, while said free tailing ends are bent from said first type contacts in a first lengthwise direction perpendicular to one of the transverse directions relative to one adjacent second type contact.

7. The electrical connector as recited in claim 6, wherein each of said free distal ends are also bent in a second lengthwise direction opposite to said first lengthwise direction.

8. The electrical connector as recited in claim 6, wherein said free distal ends are spaced with a first transverse spacing distance, each of said free distal ends is spaced from one adjacent free tailing end of the first type contact with a second transverse spacing distance less than said first transverse spacing distance.

9. An electrical connector comprising:

an insulative housing defining a mating port for mating with a complementary connector and a mounting face for mounting to a printed circuit board;

a plurality of differential pairs of signal contacts disposed in the housing, each of said differential pairs of signal contacts defining a mating contacting section exposed in the mating port and a mounting section exposed on the mounting face; and a plurality of grounding/power contacts disposed in the housing, each of the grounding/power contacts including a contacting portion exposed in the mating port and a mounting portion exposed on the mounting face; wherein the mating sections of the differential pairs of signal contacts and the mating portions of the grounding/power contacts are located in a first plane while the mounting sections of the differential pair of signal contacts are located in second plane while the mounting portions the grounding/power contacts are located in a third plane different from said second plane; wherein a pitch between the mating sections of the differential pair of signal contacts is smaller than that between the mounting sections of the same differential pair of the signal contacts.

10. The electrical connector as claimed in claim 9, wherein said second plane and said third plane are equidistant by two sides of the first plane.

11. The electrical connector as claimed in claim 9, wherein the first plane is same with the second plane.

12. The electrical connector as claimed in claim 11, wherein a pitch between the mating portions of the grounding/power contacts is essentially same with that between the mounting portions of the grounding/power contacts.

13. The electrical connector as claimed in claim 9, wherein the pitch between the mating sections of the same differential pair of signal contacts is same with that between the mating portion of one of the grounding/power contacts and the mating section of the adjacent one of the differential pair of signal contacts.

14. The electrical connector as claimed in claim 13, wherein the pitch between the mating portion of one of the grounding/power contacts and the mating section of the adjacent one of the differential pair of signal contacts is smaller than that between the mounting portion of said one of the grounding/power contacts and the mounting section of said adjacent one of the differential pair of signal contacts.

15. The electrical connector as claimed in claim 9, wherein the mounting sections of the different pair of signal contacts and the mounting portions of the grounding/power contacts by two sides, commonly define a trapezoidal configuration in a top view.

16. The electrical connector as claimed in claim 15, wherein the differential pairs of signal contacts and the grounding/power contacts commonly define juxtaposed two of said trapezoidal configuration in said top view.

* * * * *